US007607512B2

(12) United States Patent
Harwood

(10) Patent No.: US 7,607,512 B2
(45) Date of Patent: Oct. 27, 2009

(54) SPEAKER ASSEMBLY FOR A STRUCTURAL POLE AND A METHOD FOR MOUNTING SAME

(76) Inventor: Ronald Paul Harwood, 31110 Applewood, Farmington Hills, MI (US) 48331

( * ) Notice: Subject to any disclaimer, the term of this patent is extended or adjusted under 35 U.S.C. 154(b) by 398 days.

(21) Appl. No.: 11/209,794

(22) Filed: Aug. 23, 2005

(65) Prior Publication Data

US 2007/0045040 A1 Mar. 1, 2007

(51) Int. Cl.
*G09F 17/00* (2006.01)

(52) U.S. Cl. ..... 181/148; 181/199; 381/82; 381/386; 40/124.03; 40/607.05

(58) Field of Classification Search ..... 40/124.03, 40/455, 456, 457, 900, 607.04, 607.05, 427, 40/906; 381/82, 386, 388; 181/199, 148
See application file for complete search history.

(56) References Cited

U.S. PATENT DOCUMENTS

| | | | | | |
|---|---|---|---|---|---|
| 360,252 | A | * | 3/1887 | Smioth | 362/168 |
| 1,712,355 | A | | 5/1929 | Price | |
| 1,804,306 | A | | 5/1931 | Bender | |
| 1,810,264 | A | * | 6/1931 | Bonitz | 40/455 |
| 1,820,157 | A | | 8/1931 | Prochazka | |
| 1,974,039 | A | | 9/1934 | Bohannon et al. | |
| 2,143,966 | A | * | 1/1939 | Yaeger | 248/123.2 |
| 3,034,242 | A | | 5/1962 | Gold | |
| 3,058,541 | A | | 10/1962 | Leslie | |
| 3,170,538 | A | | 2/1965 | Detrick | |
| 3,310,899 | A | | 3/1967 | Hart et al. | |
| 3,683,527 | A | | 8/1972 | Gilman | |
| 3,729,706 | A | * | 4/1973 | Hein | 340/908 |
| 3,778,562 | A | | 12/1973 | Wright | |
| 3,818,138 | A | | 6/1974 | Sperrazza, Jr. | |
| 3,824,724 | A | | 7/1974 | Miller et al. | |
| 3,824,725 | A | | 7/1974 | Friedrichsen | |
| 3,831,304 | A | | 8/1974 | Miller et al. | |
| 3,832,679 | A | * | 8/1974 | Foley et al. | 340/928 |
| 3,919,499 | A | | 11/1975 | Winey | |
| 4,063,387 | A | | 12/1977 | Mitchell | |
| 4,160,882 | A | | 7/1979 | Driver | |

(Continued)

FOREIGN PATENT DOCUMENTS

| | | |
|---|---|---|
| GB | 319788 | 11/1930 |

(Continued)

OTHER PUBLICATIONS

International Search Report and Written Opinion for corresponding PCT Application No. PCT/US06/32154, mailed Mar. 26, 2008, 10 pages.

*Primary Examiner*—Jeffrey Donels
*Assistant Examiner*—Jeremy Luks
(74) *Attorney, Agent, or Firm*—Brooks Kushman P.C.

(57) ABSTRACT

A speaker assembly for a structural pole is provided, as well as a method for attaching a speaker assembly to a structural pole. The speaker assembly is provided with an elongated housing mounted to banner brackets that are fixed to the structural pole. The housing is sized to provide an aesthetic appearance that corresponds to a banner attached to the banner brackets. A speaker, or a plurality of speakers are provided within the housing for transmitting acoustic vibrations to a corresponding environment.

26 Claims, 6 Drawing Sheets

U.S. PATENT DOCUMENTS 4,222,188 A * 9/1980 Tarrant et al. ..... 40/717
4,289,936 A 9/1981 Civitello
4,472,604 A 9/1984 Nakamura et al.
4,550,228 A 10/1985 Walker et al.
4,574,906 A 3/1986 White et al.
4,662,096 A * 5/1987 Bayless et al. ..... 40/607.03
4,754,852 A 7/1988 Mule et al.
4,934,079 A * 6/1990 Hoshi ..... 40/427
4,939,784 A 7/1990 Bruney
4,949,386 A 8/1990 Hill
5,115,472 A * 5/1992 Park et al. ..... 381/152
5,182,872 A * 2/1993 Lee et al. ..... 40/717
5,275,285 A * 1/1994 Clegg ..... 206/449
5,392,358 A 2/1995 Driver
5,444,194 A 8/1995 Reinke
5,463,973 A * 11/1995 Tait ..... 116/173
5,577,918 A * 11/1996 Crowell ..... 434/319
5,588,063 A * 12/1996 Edgar ..... 381/300
5,702,081 A 12/1997 Gallemore, II
5,802,190 A 9/1998 Ferren
5,802,193 A 9/1998 Kieltyka
5,828,765 A 10/1998 Gable
5,887,071 A 3/1999 House
5,920,634 A * 7/1999 Chiquette ..... 381/124
5,946,401 A * 8/1999 Ferren ..... 381/82
6,028,752 A * 2/2000 Chomette et al. ..... 360/137
6,056,083 A * 5/2000 Daniell ..... 181/199
6,058,196 A 5/2000 Heron
6,175,636 B1 1/2001 Norris et al.
6,188,772 B1 2/2001 Norris et al.
6,215,882 B1 4/2001 Heron
6,285,773 B1 9/2001 Carme et al.
6,304,662 B1 10/2001 Norris et al.
6,335,975 B1 1/2002 Yang
6,340,936 B1 * 1/2002 McGaffey et al. ..... 340/944
6,411,723 B1 6/2002 Lock et al.
6,493,973 B1 12/2002 Nelson
6,643,966 B2 11/2003 Schmitt
6,665,968 B2 12/2003 Jen
6,687,381 B2 2/2004 Yanagawa et al.
6,698,122 B1 3/2004 Merenlender
6,769,509 B2 * 8/2004 Harwood ..... 181/199
6,786,793 B1 * 9/2004 Wang ..... 446/226
6,990,921 B2 * 1/2006 Milner et al. ..... 116/173
7,117,619 B1 * 10/2006 Huber ..... 40/495
7,204,372 B2 * 4/2007 Kin et al. ..... 211/45
7,219,873 B2 * 5/2007 Harwood ..... 248/519
7,234,253 B2 * 6/2007 Ossmann ..... 40/124.14
2002/0053153 A1 * 5/2002 Nesbitt et al. ..... 40/607
2002/0111203 A1 8/2002 Chi
2003/0041494 A1 3/2003 Yucht
2003/0154638 A1 * 8/2003 Kern et al. ..... 40/492
2003/0159321 A1 * 8/2003 Dobbins ..... 40/607.05
2003/0197026 A1 10/2003 Ashe
2004/0118630 A1 6/2004 Harwood
2004/0163292 A1 * 8/2004 Wilson ..... 40/597
2005/0045777 A1 * 3/2005 Lee et al. ..... 248/121
2005/0246928 A1 * 11/2005 Lee ..... 40/564
2006/0062402 A1 * 3/2006 Heil ..... 381/82
2006/0139750 A1 * 6/2006 Solomon ..... 359/462
2006/0236577 A1 * 10/2006 Arvanitis ..... 40/612
2007/0113433 A1 * 5/2007 Moore ..... 40/124.08

FOREIGN PATENT DOCUMENTS

GB 1105627 3/1968
GB 2344685 A 6/2000
JP 2000125376 A 4/2000
JP 2000125390 A 4/2000
JP 2000236595 A 8/2000
JP 200391249 A 3/2003
WO WO03/019976 A2 * 3/2003
WO 2004038134 A1 5/2004
WO WO 2005052898 A2 * 6/2005

* cited by examiner

SPEAKER ASSEMBLY FOR A STRUCTURAL POLE AND A METHOD FOR MOUNTING SAME

BACKGROUND OF THE INVENTION

1. Field of the Invention

The invention relates to a speaker assembly, more particularly to a speaker assembly for a structural pole.

2. Background Art

Many outdoor and indoor public environments and thoroughfares utilize speakers, speaker systems or public address systems for amplifying sound and/or sound reproduction. Such areas may include city streets, parks, residential neighborhoods, office buildings, campuses, exterior walkways, shopping malls, casinos, dealerships, sports venues, atriums, amusement parks, wharfs, or the like. These areas typically utilize speakers or speaker systems that are mounted to existing building structures, structural poles, or the like. Much effort is employed in installation of these systems and protecting these systems from vandalism, theft and/or the weather.

The prior art has offered methods and apparatuses for mounting speakers and speaker systems in public areas. The prior art also provides apparatuses for protecting speakers from the elements. The prior art has offered solutions for concealing speaker systems in public areas. Many prior art speaker systems may be costly in light of the advantages provided due to manufacturing costs of various components and complex apparatuses for concealing or protecting the speakers. Further, these prior art speaker systems may detract from the aesthetic appearance of the environment.

Often, a structural pole has a primary feature, such as providing lighting to a thoroughfare. The structural pole may also serve a display purpose, by utilization of a banner or a plurality of banners mounted to the structural pole by banner brackets.

A simplified speaker apparatus and system is needed for use in public environments that incorporates the speaker system into existing or accepted objects within the environment for providing a desired quality in amplitude of sound reproduction, while not upsetting or obfuscating the aesthetic appearance or display of the area.

SUMMARY OF THE INVENTION

A non-limiting embodiment of the present invention provides a speaker assembly for attachment to a structural pole. A speaker assembly includes an elongate housing having an upper end and a lower end, each adapted to be secured to a banner bracket of a structural pole. The housing provides an aesthetic appearance that corresponds with a banner attached to the banner brackets of the structural pole. At least one speaker is retained within the housing and is oriented to face generally outward from the housing for transmitting acoustic vibrations to a corresponding environment.

Another non-limiting embodiment of the present invention provides a method for mounting a speaker assembly to a structural pole. A speaker assembly is provided having an elongate housing with a speaker disposed therein. The speaker assembly is mounted to banner brackets on a structural pole.

DESCRIPTION OF EMBODIMENTS OF THE INVENTION

As required, detailed embodiments of the present invention are disclosed herein; however, it is to be understood that the disclosed embodiments are merely exemplary of the invention that may be embodied in various and alternative forms. The figures are not necessarily to scale, some features may be exaggerated or minimized to show details of particular components. Therefore, specific structural and functional details disclosed herein are not to be interpreted as limiting, but merely as a representative basis for the claims and/or as a representative basis for teaching one skilled in the art to variously employ the present invention.

Figure 1:
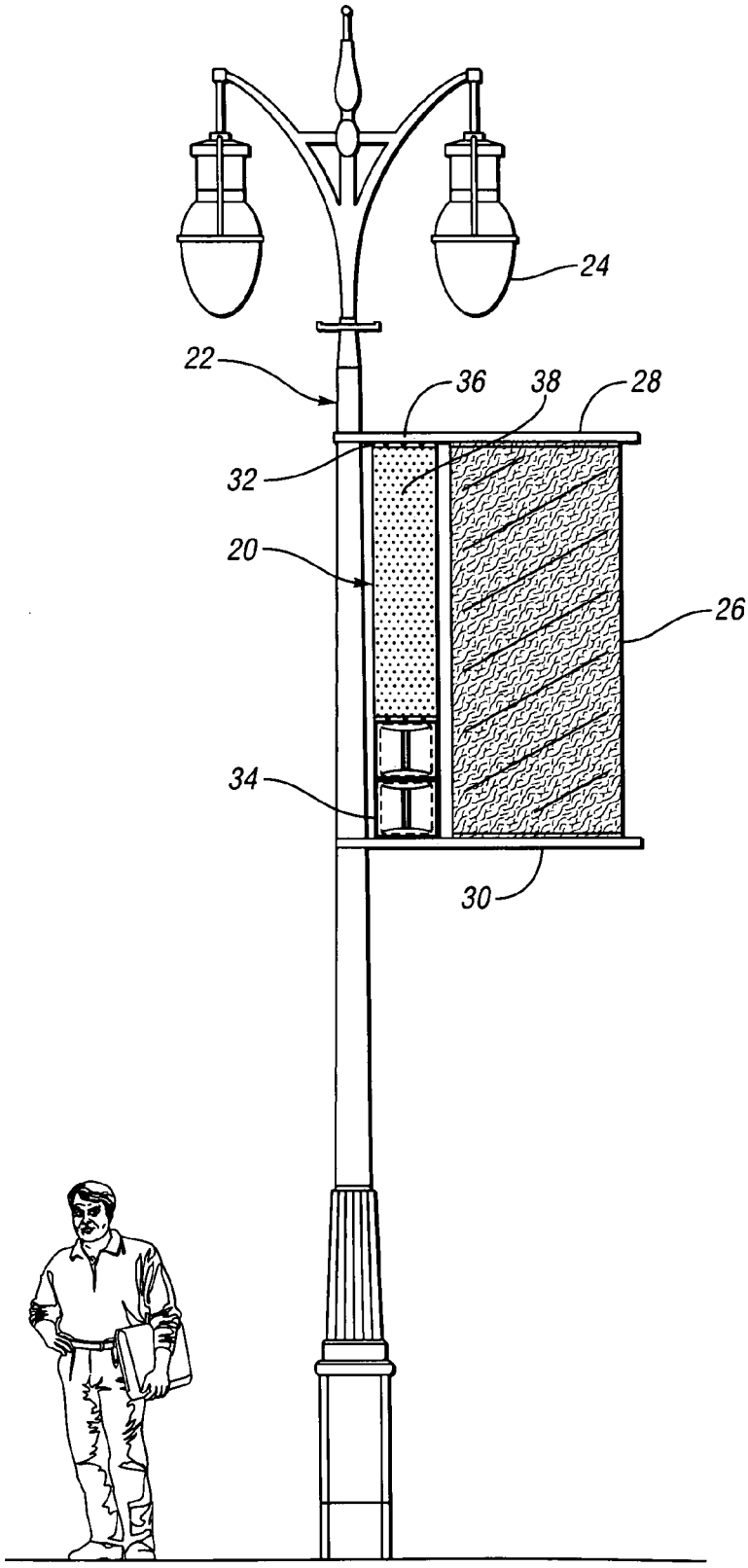
FIG. 1 is a front side elevation view of a speaker assembly in accordance with the present invention, illustrated mounted to a structural pole.

With reference now to FIG. 1, a speaker assembly is illustrated in accordance with the present invention, and referenced generally by numeral 20. The speaker assembly 20 is illustrated attached to a structural pole 22. The structural pole 22, for example, may be a light pole having a light source 24 supported therefrom for illuminating an underlying environment or thoroughfare.

The structural pole 22 is also provided for displaying a banner 26. Accordingly, an upper banner bracket 28 and a lower banner bracket 30 are provided on the structural pole 22 for securing and displaying the banner 26. An upper end 32 of the speaker assembly 20 is attached to the upper banner bracket 28 and a lower end 34 of the speaker assembly 20 is attached to the lower banner bracket 30.

The speaker assembly 20 may be dimensioned to attach to conventional banner brackets 28, 30 and may be sized for placement between the structural pole 22 and the banner 26. The speaker assembly 20 may be sized to provide an aesthetic appearance that corresponds with that of a conventional banner 26. Thus, the speaker assembly 20 and the structural pole 22 blend harmoniously into the environment. Moreover, as speaker assemblies are utilized in places of public congregation, there is a need for blending the aesthetics of structural pole 22, the banner 26 and the speaker assembly 20. Thus, the generally linear or vertical arrangement of the speaker assembly 20 facilitates cooperation of the speaker assembly 20 with commercially available banner mounting equipment such as the upper and lower banner brackets 28, 30. Of course, the invention contemplates that the speaker assembly 20 may include dedicated brackets for supporting both the speaker assembly 20 and the banner 26.

By providing the speaker assembly 20 with dimensions that match conventional or standard banner sizes, existing structural poles having a banner 26 and banner brackets 28, 30 may be retrofitted with a speaker assembly 20.

The invention contemplates that more than one speaker assembly 20 may be provided on the banner brackets 28, 30. Additionally, the present invention contemplates that the speaker assembly 20 may be provided adjacent to the banner 26 as illustrated, or may be provided behind the banner 26. Often, the banner brackets 28, 30 support a pair of banners 26, each facing opposed directions. Thus, the invention contemplates that the speaker assembly 20 may be provided between the pair of banners 26 thereby concealing the speaker assembly 20.

The prior art has provided banners and banner brackets that extend on one lateral side of a structural pole 22, as illustrated in FIG. 1. The prior art has also provided banners 26 and banner brackets 28, 30 that extend laterally from more than one side of a structural pole 22. Thus, the invention contemplates utilization of the speaker assembly 20 on one or more lateral side of the structural pole 22. By utilization of both lateral sides of the structural pole 22, a pair of speaker assemblies 20 may be provided, each facing opposed directions for transmitting acoustical vibrations to both a front side and a rear side of the thoroughfare with respect to the banners 26.

Figure 2:
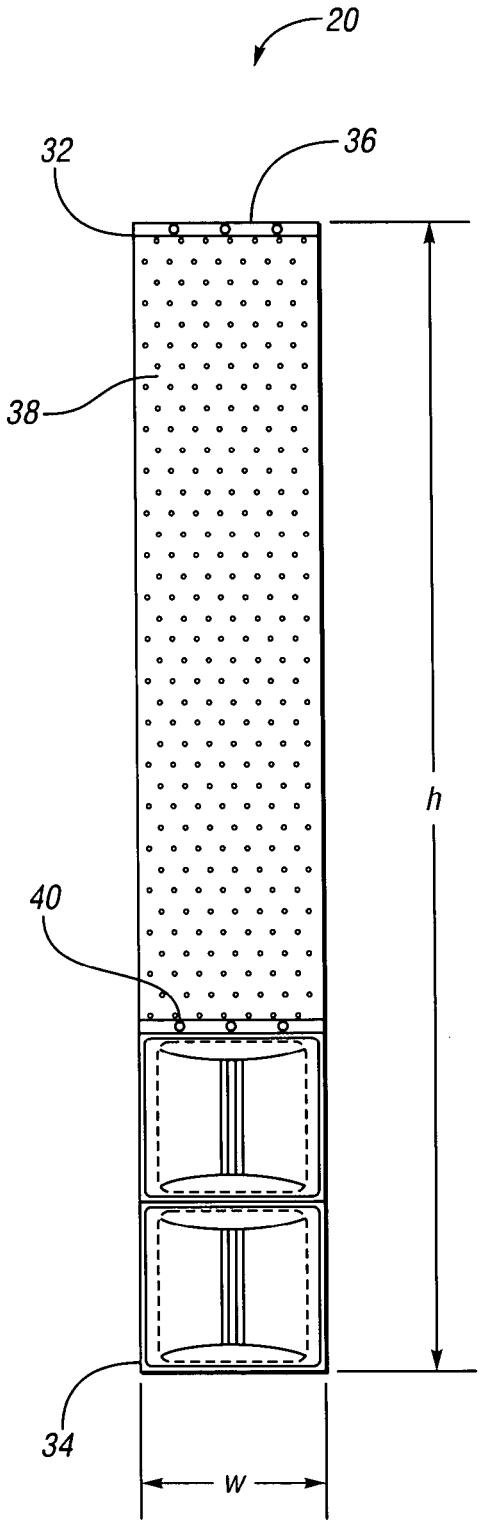
FIG. 2 is an enlarged front side elevation view of the speaker assembly of FIG. 1.
Figure 3:
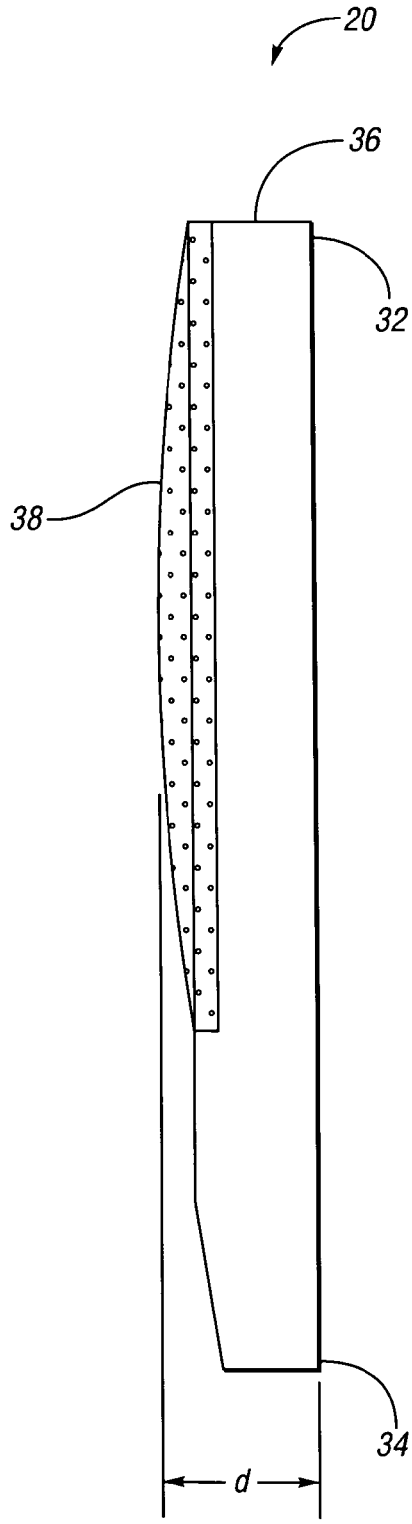
FIG. 3 is an enlarged right side elevation view of the speaker assembly of FIG. 1.

With reference now to FIGS. 2 and 3, the speaker assembly 20 is illustrated enlarged for greater detail. The speaker assembly 20 includes an elongate housing 36 for attachment to the banner brackets 28, 30 and for housing speakers therein. Overall, the speaker assembly 20 has a height (h) (for example 5'-0" for the embodiment illustrated), a width (w) (for example, 7½"), and a depth (d) (for example, 4¼").

In order to incorporate the speaker assembly 20 into an aesthetic appearance provided by the structural pole 22 and the banner 26, the speaker assembly 20 is designed for a minimal depth (d). Thus, the speaker assembly 20 is provided generally linear with the width (w) and depth (d) minimized by sizing them to match speakers housed within the elongate housing 36.

For purposes of retrofitting existing banner hardware, the height (h) may be sized to match a corresponding height of the banner 26. The depth (d) which is oriented generally tangential to the structural pole 22, may be sized to match a spacing between opposed faces of banners 26 mounted to the brackets 28, 30. Thus, the depth (d) may be minimized when the height and width are sized to adequately provided a resonating chamber within the elongate housing 36 proportional to speakers provided therein. In order to further blend the speaker assembly 20 within the aesthetic appearance, the depth (d) may be less than or equal to a diameter of the structural pole 22 proximate to the speaker assembly 20, such as within a region of the pole 22 that is oriented between the banner brackets 28, 30.

The invention also contemplates that the width (w) of the speaker assembly 20 may be sized to place the speaker assembly 20 within a gap provided between the structural pole 22 and the banner 26 for retrofitting existing structural poles 22.

The elongate housing 36 may be formed unitarily from a polymeric material. Alternatively, the elongate housing 36 may be formed of a plurality of polymeric panels which are subsequently fastened and adhered together along the seams for resulting in a water tight or weather-proof housing. Alternatively, the housing 36 may be formed from stamped weather-proof sheet metal, such as aluminum or stainless steel, or sheet metal that is coated with a material to make it weather-proof. The interior of the housing 36 may include foam or some other absorbent material for reducing vibrations and providing an adequate resonating chamber for the corresponding speakers.

The speaker assembly 20 includes a screen 38 on the front of the housing 36. The screen 38 is acoustically transparent and shields and protects components within the housing 36. The screen 38 may be formed of any weather-proof acoustically transparent material. The screen 38 illustrated is stamped from stainless steel, such as twelve or fifteen gauge, which is seventy percent perforated for permitting acoustical vibrations to transmit therethrough. The perimeter of the shield may be lined with an elastomeric gasket for sealing the screen 38 to the housing 36. Additionally, a weather-proof foam may be provided on the interior of the screen 38 for preventing elements from passing through the screen, while permitting acoustic vibrations to transmit through the screen 38. The screen 38 may be secured to the housing 36 by a plurality of fasteners 40 about its periphery.

The screen 38 may be formed from any kind of speaker grill that is moisture and weather resistant, that is paintable or accepts a silk-screened material for applying graphics thereto. Further, permanent graphics may be applied to the screen 38 by painting the screen. A banner portion may be affixed to the screen 38 with velcro for adhering it about its periphery. The screen 38 may serve as a banner itself, or may compliment the banner 26 on the structural pole 22.

Figure 4:
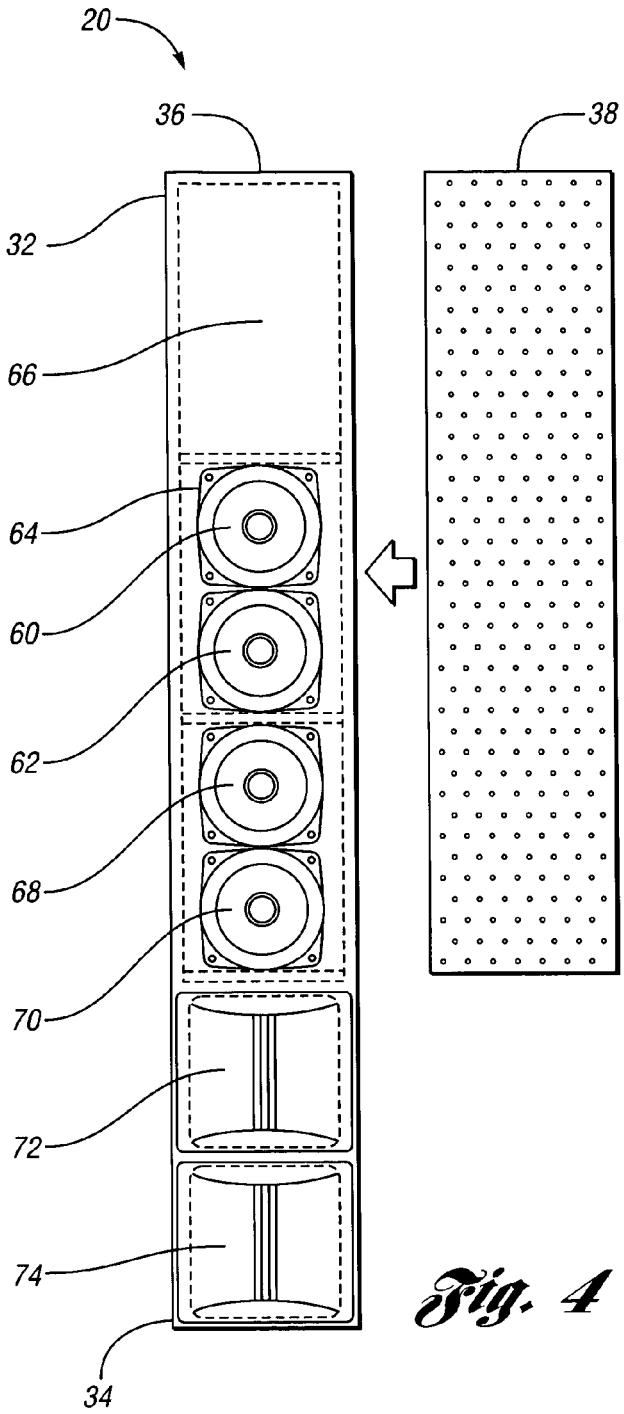
FIG. 4 is a front side elevation view of the speaker assembly of FIG. 1, illustrated with a screen removed therefrom.
Figure 5:
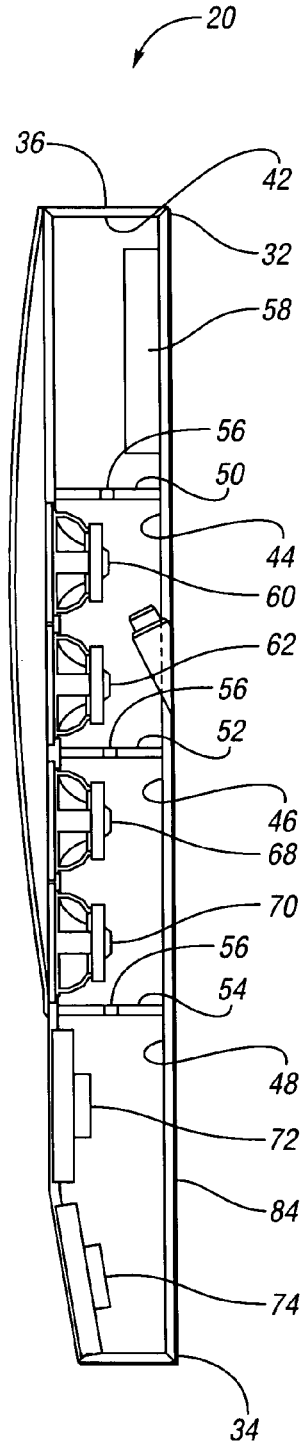
FIG. 5 is a right side partial section view of the speaker assembly of FIG. 1.

In FIG. 4, the speaker assembly 20 is illustrated with the screen 38 removed for illustrating components within the housing 36. Additionally, FIG. 5 illustrates a fragmented side view for illustration of the components within the housing 36. The elongate housing 36 includes four distinct regions within its internal cavity. Specifically, there is an upper region 42, an upper intermediate region 44, a lower intermediate region 46 and a lower region 48. Each of these regions 42, 44, 46, 48 is divided from one another by a subplate 50, 52, 54 for preventing acoustical vibrations provided by the speaker assembly from resonating throughout the elongate housing 36. Specifically, each of the upper intermediate region 44, lower intermediate region 46 and lower region 48 provide a resonating chamber for the corresponding speakers provided for each region. Each of the subplates 50, 52, 54, includes an aperture 56 formed therethrough for permitting wiring to pass through each region to the corresponding speakers. Each of these apertures 56 may be sealed by a grommet or the like for preventing acoustical vibrations to pass therethrough.

The upper region 42 of the elongate housing 36 houses an amplifier 58 for receiving a power source and a signal and amplifying that signal to the speakers within the speaker assembly 20.

The upper intermediate region 44 includes a pair of woofers 60, 62, which are cone speakers having a flange 64 fastened to a front face 66 of the elongate housing 36. The woofers 60, 62 are low frequency speakers. The rear portion of the woofers 60, 62 extends within the upper intermediate region 44, which acts as a resonating chamber providing back pressure to these speakers.

Likewise, the lower intermediate region 46 also includes a pair of woofers 68, 70. The lower intermediate region 46 serves as a resonating chamber for the woofers 68, 70.

The lower region 48 includes a pair of high frequency drivers 72, 74, and the lower region provides a resonating chamber for the high frequency drivers 72, 74. The high frequency drivers may be cone speakers, tweeters, or the like. The woofers 60, 62, 68, 70 and the high frequency drivers 72, 74 are all stacked linearly, in a direction that is parallel to an axial direction of the structural pole 22, for minimizing the width (w) of the speaker assembly 20.

Figure 6:
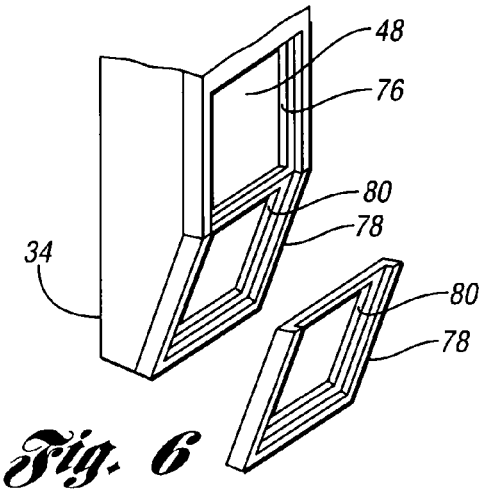
FIG. 6 is an enlarged perspective view of a lower end of the speaker assembly of FIG. 1.

With reference now to FIG. 6, the lower end 34 of the speaker assembly 20 is illustrated enlarged for detail. The face 66 of the elongate housing 36 includes an aperture 76 formed therein that is sized for receiving the high frequency driver 72. The elongate housing 36 also includes an inset 78 having an aperture 80 formed therethrough for receiving the high frequency driver 74. The inset 78 is canted with respect to the face 66 of the elongate housing 36 for even sound distribution. Specifically, the inset 78 is illustrated with a nine degree offset from the face 66 for orienting the high frequency driver 74 offset from horizontal. The inset 78 may be formed separately from the elongate housing 36, as illustrated in FIG. 6 for affixing the inset 78 to the elongate housing 36 in the manufacturing process.

The linear array of the horizontal facing woofers 60, 62, 68, 70 and high frequency driver 72 in combination with the angled high frequency driver 74 provides uniform sound distribution as experienced by a passerby that is at least six to eight feet from the speaker assembly 20 up to 120 to 140 feet from the speaker assembly 20 in a region that faces the speaker assembly 20.

The invention contemplates utilization of speaker assemblies in accordance with the present invention for smaller ranges of sound distribution than that provided by the speaker assembly 20 of the present invention. For example, the speaker assembly may include an electrostatic speaker. Electrostatic speakers provide sound distribution over a limited range, but only require a housing having a depth of approximately 3½". A speaker assembly having a housing with a depth of only two inches is adequately thin enough to conceal behind the banner 26, between banners 26, or in other configurations.

Figure 7:
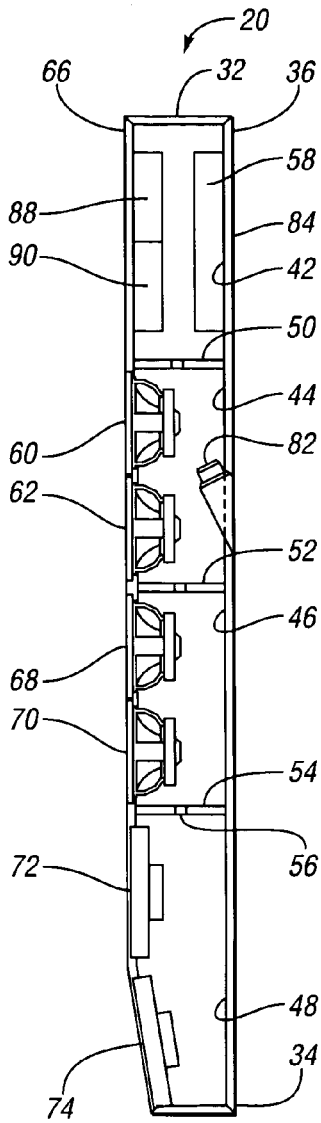
FIG. 7 is a right side partial section view of the speaker assembly of FIG. 1, illustrated with the screen removed therefrom.
Figure 8:
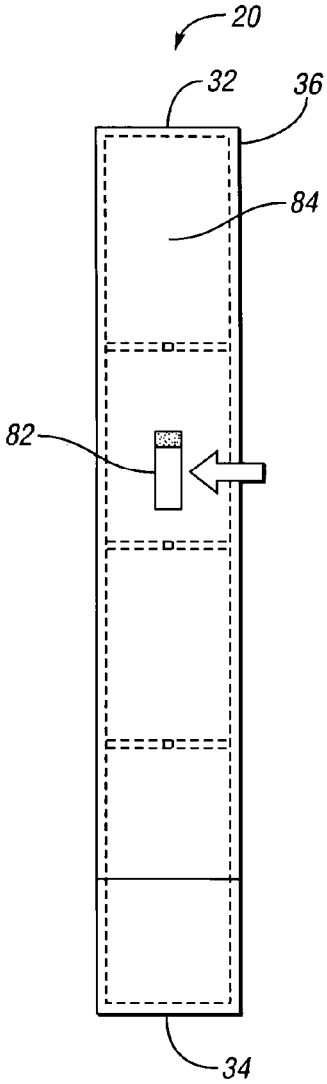
FIG. 8 is a back side elevation view of the speaker assembly of FIG. 1.
Figure 9:
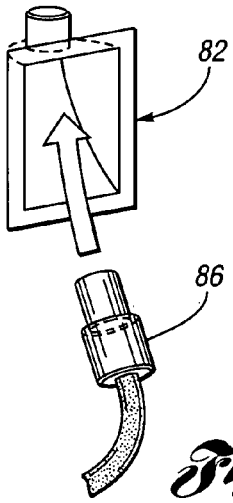
FIG. 9 is an enlarged perspective view of a port of the speaker assembly of FIG. 1.

With reference now to FIGS. 7 through 9, the elongate housing 36 includes a port 82 formed within a backplate 84 of the housing 36. The port 82 receives a plug 86 for conveying wiring to the speaker assembly 20. Specifically, wires may be conveyed through the structural pole 22, from an access panel in the structural pole 22, to the port 82 in the speaker assembly 20. The wiring may include a power source, a signal source, or the like.

Alternatively, the speaker assembly 20 may have its own source of power such as a battery 88 located in the upper region 42. Additionally, a solar panel may be provided atop the speaker assembly 20 for converting solar power into power stored in the battery 88.

The speaker assembly 20 may include a driver or processor 90 for providing a signal source to the speakers 60, 62, 68, 70, 72, 74. The processor 90 may include a receiver for receiving a signal source, which is amplified by the amplifier 84 and then transmitted to the speakers 60, 62, 68, 70, 72, 74. Alternatively, the processor 90 may include a series of preprogrammed audio outputs, such as songs, messages or the like and the receiver may receive a signal instructing the processor 90 to play a particular medium.

Figure 10:
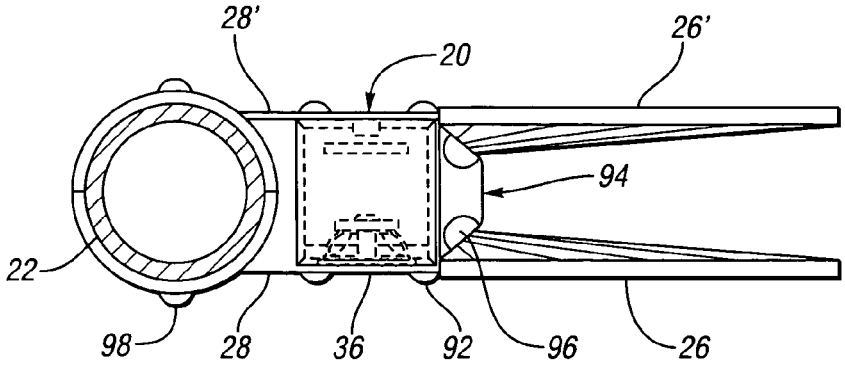
FIG. 10 is a top plan view of the speaker assembly and the structural pole of FIG. 1, illustrated with an alternative embodiment light source in accordance with the present invention.

With reference now to FIG. 10, a top plan view of the speaker assembly 20 is illustrated in cooperation with the structural pole 22. The speaker assembly 20 is mounted to a pair of upper banner brackets 28, 28' by a plurality of fasteners 92. Although not illustrated in FIG. 10, the speaker assembly 20 is also fastened to a pair of lower banner brackets 30, 30' by a plurality of fasteners 92. The speaker assembly 20 is placed between the structural pole 22 and a pair of banners 26, 26' which each face opposed directions.

The banners 26, 26' may be illuminated by the light source 24. Additionally, a lighting kit 94 may be mounted upon the side of the speaker assembly 20 or to the brackets 28, 28', 30, 30'. The lighting kit 94 may include a plurality of lights 96 for illuminating the banners 26, 26' from behind. The lights 96 are adjustable and may also be aimed directly downward for illuminating a pathway below. Additionally, lighting may be provided within the elongate housing 36 for lighting the speaker assembly 20 or the screen 38.

Figure 11:
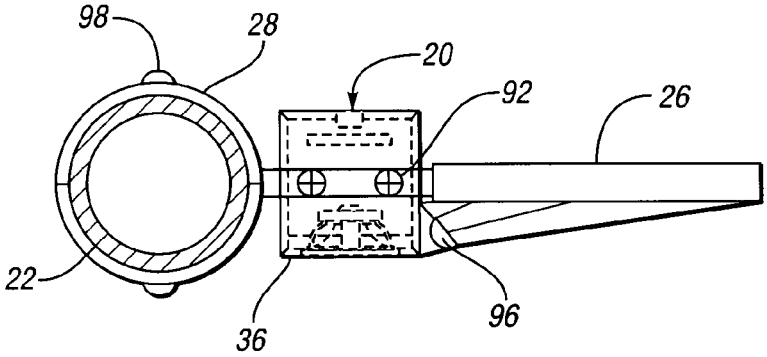
FIG. 11 is a top plan view of the speaker assembly of FIG. 1, illustrated attached to a structural pole by an alternative attachment apparatus in accordance with the present invention.

Referring now to FIG. 11, a top plan view of the speaker assembly 20 is illustrated with an alternative mounting configuration for the structural pole 22. The mounting configuration includes a single upper bracket 28 secured to the structural pole 22 by fasteners 98. The speaker assembly 20 is fastened to the upper bracket 28 and a similar lower bracket 30. These brackets 28, 30 include a single banner 26 extending from the upper bracket 28 to the lower bracket 30. Accordingly, the speaker assembly 20 may include adjustable lights 96 for illuminating a front face of the banner 26 or for illuminating the banner 26 from behind.

Figure 12:
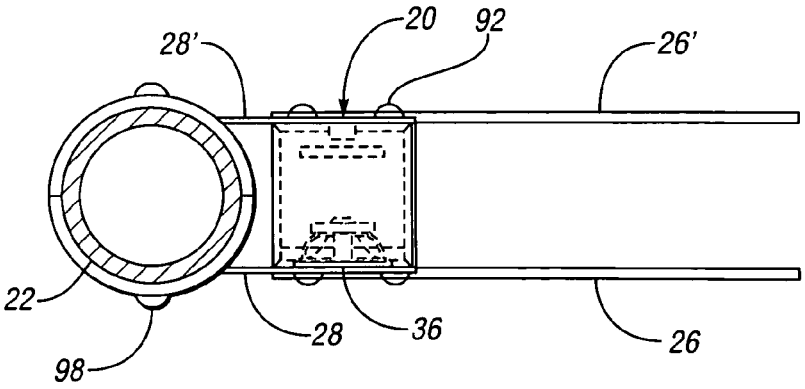
FIG. 12 is a top plan view of the speaker assembly of FIG. 1, illustrated attached to a structural pole by another alternative attachment apparatus in accordance with the present invention.

Referring now to FIG. 12, another alternative mounting configuration is illustrated for the speaker assembly 20. Specifically, the banners 26, 26' extend sufficiently laterally inward to the structural pole 22 to completely conceal the face 66 and the backplate 84 of the speaker assembly 20. Thus, when a pedestrian faces either banner 26, 26', the speaker assembly 20 cannot be viewed and therefore does not detract from the ornamental or aesthetic appearance provided by the structural pole 22 and the banners 26, 26'.

Figure 13:
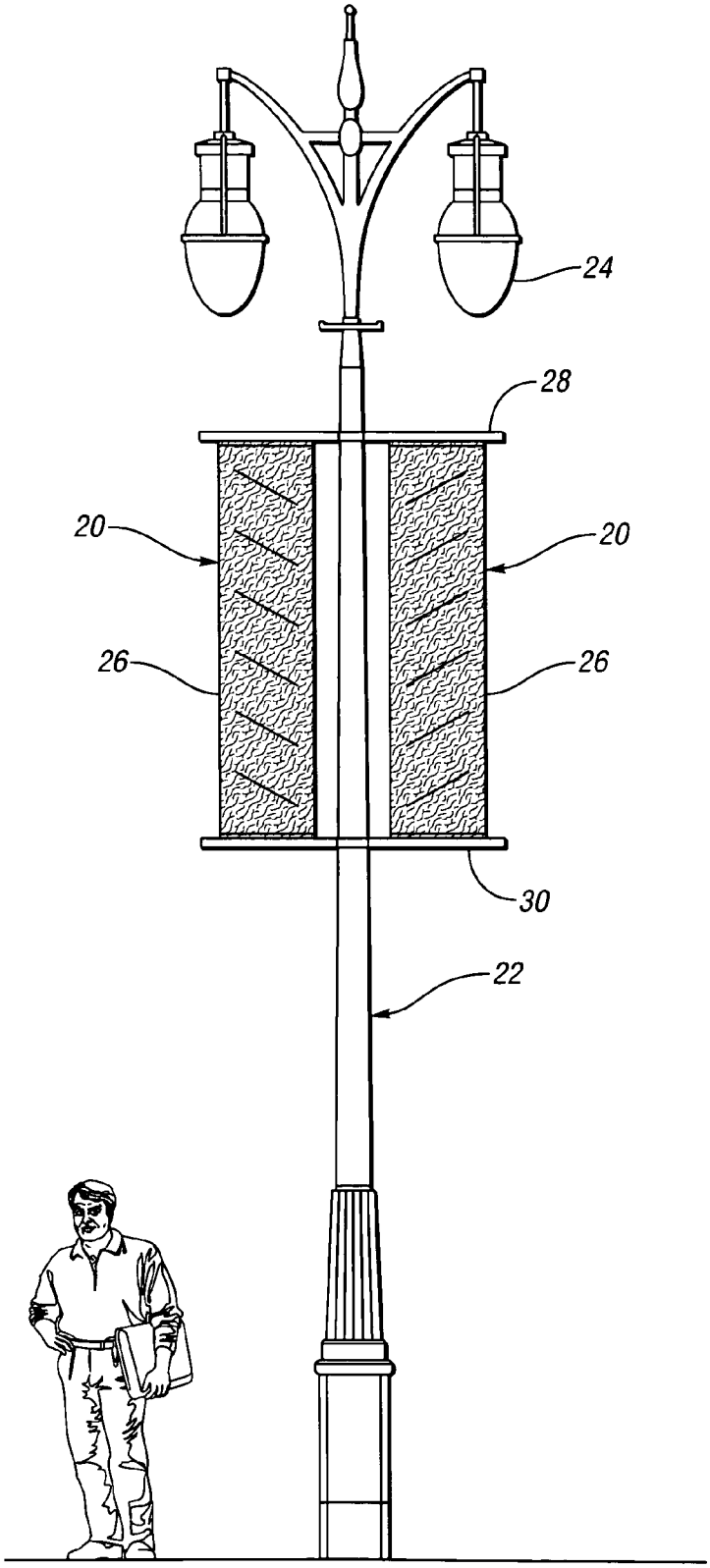
FIG. 13 is a front side elevation view of an alternative embodiment speaker assembly in accordance with the present invention, illustrated attached to a structural pole.

FIG. 13 illustrates another alternative mounting configuration for the speaker assembly 20 in accordance with the present invention. Specifically, the banners 26 are each disposed over a speaker assembly 20 and the banners 26 are each sized to completely conceal the speaker assembly 20. By providing banners 26 on both lateral sides of the structural pole 22, the speaker assemblies 20 may face opposed directions for providing sound distribution from opposed directions of the structural pole 22.

In summary, a speaker assembly is provided that may be incorporated into an aesthetic or ornamental environment without detracting from or disturbing the appearance.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A speaker assembly for attachment to a structural pole, the speaker assembly comprising:

an elongate housing adapted to be affixed to a banner bracket of a structural pole such that the elongate housing is generally parallel with the structural pole and spaced laterally from the structural pole, and the housing being sized to retain at least one speaker therein wherein the housing provides an aesthetic appearance corresponding to a banner attached to a structural pole; and at least one speaker retained within the housing and oriented to face generally outward from the housing for transmitting acoustic vibrations to a corresponding environment;

wherein the housing further comprises a height sized to match a height of a banner of the structural pole, and a depth oriented generally tangential of the pole, the depth being sized to match a spacing between opposed faces of the banner.

2. The speaker assembly of claim 1 further comprising an upper banner bracket mounted to a structural pole, wherein the elongate housing has an upper end affixed to the upper banner bracket of the structural pole for supporting the elongate housing upon the structural pole.

3. The speaker assembly of claim 2 further comprising a lower banner bracket mounted to the structural pole, wherein the elongate housing has a lower end affixed to the lower banner bracket of the structural pole for supporting the elongate housing upon the structural pole.

4. The speaker assembly of claim 2 wherein the height of the housing is oriented in an axial direction of the structural pole, wherein the housing farther comprises a width oriented in a direction that the upper banner bracket extends from the structural pole, and wherein the depth of the housing is oriented generally perpendicular to the height and the width, wherein the height and width of the housing are each greater than the housing depth.

5. The speaker assembly of claim 3 wherein the height of the housing is oriented in an axial direction of the structural pole, wherein the housing further comprises a width oriented in a direction that the banner brackets extend from the structural pole, and wherein the depth of the housing is oriented generally perpendicular to the height and the width, wherein the depth is less than or equal to a diameter of a region of the structural pole oriented between the banner brackets.

6. The speaker assembly of claim 2 wherein the housing further comprises a width oriented in a direction that the upper banner bracket extends from the structural pole, and the width is sized to orient the speaker assembly disposed between and laterally adjacent to both of the structural pole and a banner on the upper banner bracket.

7. The speaker assembly of claim 1 wherein the at least one speaker further comprises a plurality of speakers.

8. The speaker assembly of claim 1 wherein the at least one speaker further comprises a cone speaker.

9. The speaker assembly of claim 1 wherein the speaker assembly is adapted to receive a banner mounted thereto for aesthetically concealing the speaker assembly.

10. The speaker assembly of claim 2 further comprising a light source for illuminating a banner mounted to the upper banner bracket.

11. The speaker assembly of claim 1 further comprising a light source for illuminating a region of a corresponding thoroughfare.

12. The speaker assembly of claim 1 wherein the speaker assembly is wired into the structural pole for receiving a power source.

13. The speaker assembly of claim 1 further comprising a receiver mounted within one of the structural pole and the speaker assembly housing for receiving a wireless signal.

14. The speaker assembly of claim 1 wherein the at least one speaker further comprises a linear array of speakers.

15. The speaker assembly of claim 14 wherein the linear array of speakers are oriented in an axial direction of the structural pole.

16. The speaker assembly of claim 14 wherein at least one speaker of the linear array of speakers is oriented facing a direction that is angularly offset from a tangential direction relative to the structural pole for directing acoustical vibrations to a targeted region in a corresponding thoroughfare.

17. The speaker assembly of claim 14 wherein at least one speaker of the linear array of speakers is oriented facing a direction that is angularly offset from a horizontal direction for even sound distribution to a corresponding thoroughfare.

18. A method for mounting a speaker assembly to a structural pole, the method comprising:

providing a speaker assembly having an elongate housing with a speaker therein;

mounting the speaker assembly to at least one banner bracket on a structural pole such that the elongate housing is supported by the at least one banner bracket without contacting the structural pole; and orienting the speaker assembly laterally between the structural pole and a banner on the at least one banner bracket.

19. The method of claim 18 further comprising mounting a banner to the at least one banner bracket.

20. A speaker assembly for attachment to a structural pole, the speaker assembly comprising:

an elongate housing adapted to be affixed to a banner bracket of a structural pole such that the elongate housing is generally parallel with the structural pole and spaced laterally from the structural pole, and the housing being sized to retain at least one speaker therein wherein the housing provides an aesthetic appearance corresponding to a banner attached to a structural pole;

at least one speaker retained within the housing and oriented to face generally outward from the housing for transmitting acoustic vibrations to a corresponding environment; and an upper banner bracket mounted to a structural pole, wherein the elongate housing has an upper end affixed to the upper banner bracket of the structural pole for supporting the elongate housing upon the structural pole;

wherein the housing further comprises a height oriented in an axial direction of the structural pole, a width oriented in a direction that the upper banner bracket extends from the structural pole, and a depth oriented generally perpendicular to the height and the width, wherein the height and width of the housing are each greater than the housing depth.

21. A speaker assembly for attachment to a structural pole, the speaker assembly comprising:

an elongate housing adapted to be affixed to a banner bracket of a structural pole such that the elongate housing is generally parallel with the structural pole and spaced laterally from the structural pole, and the housing being sized to retain at least one speaker therein wherein the housing provides an aesthetic appearance corresponding to a banner attached to a structural pole;

at least one speaker retained within the housing and oriented to face generally outward from the housing for transmitting acoustic vibrations to a corresponding environment; and an upper banner bracket mounted to a structural pole, wherein the elongate housing has an upper end affixed to the upper banner bracket of the structural pole for supporting the elongate housing upon the structural pole;

wherein the housing further comprises a width oriented in a direction that the upper banner bracket extends from the structural pole, and the width is sized to orient the speaker assembly disposed between and laterally adjacent to both of the structural pole and a banner on the upper banner bracket.

22. A speaker assembly for attachment to a structural pole, the speaker assembly comprising:

an elongate housing adapted to be affixed to a banner bracket of a structural pole such that the elongate housing is generally parallel with the structural pole and spaced laterally from the structural pole, and the housing being sized to retain at least one speaker therein wherein the housing provides an aesthetic appearance corresponding to a banner attached to a structural pole; and at least one speaker retained within the housing and oriented to face generally outward from the housing for transmitting acoustic vibrations to a corresponding environment;

wherein the at least one speaker further comprises a linear array of speakers; and wherein the linear array of speakers are oriented in an axial direction of the structural pole.

23. A speaker assembly for attachment to a structural pole, the speaker assembly comprising:

an elongate housing adapted to be affixed to a banner bracket of a structural pole such that the elongate housing is generally parallel with the structural pole and spaced laterally from the structural pole, and the housing being sized to retain at least one speaker therein wherein the housing provides an aesthetic appearance corresponding to a banner attached to a structural pole; and at least one speaker retained within the housing and oriented to face generally outward from the housing for transmitting acoustic vibrations to a corresponding environment;

wherein the at least one speaker further comprises a linear array of speakers; and wherein at least one speaker of the linear array of speakers is oriented facing a direction that is angularly offset from a tangential direction relative to the structural pole for directing acoustical vibrations to a targeted region in a corresponding thoroughfare.

24. A speaker assembly for attachment to a structural pole, the speaker assembly comprising:

an elongate housing adapted to be affixed to a banner bracket of a structural pole such that the elongate housing is generally parallel with the structural pole and spaced laterally from the structural pole, and the housing being sized to retain at least one speaker therein wherein the housing provides an aesthetic appearance corresponding to a banner attached to a structural pole; and at least one speaker retained within the housing and oriented to face generally outward from the housing for transmitting acoustic vibrations to a corresponding environment;

wherein the at least one speaker further comprises a linear array of speakers; and wherein at least one speaker of the linear array of speakers is oriented facing a direction that is angularly offset from a horizontal direction for even sound distribution to a corresponding thoroughfare.

25. A speaker assembly for attachment to a structural pole, the speaker assembly comprising:

an elongate housing adapted to be affixed to a banner bracket of a structural pole such that the elongate housing is generally parallel with the structural pole and spaced laterally from the structural pole, and the housing being sized to retain at least one speaker therein wherein the housing provides an aesthetic appearance corresponding to a banner attached to a structural pole;

at least one speaker retained within the housing and oriented to face generally outward from the housing for transmitting acoustic vibrations to a corresponding environment;

an upper banner bracket mounted to a structural pole, wherein the elongate housing has an upper end affixed to the upper banner bracket of the structural pole for supporting the elongate housing upon the structural pole; and a lower banner bracket mounted to the structural pole, wherein the elongate housing has a lower end affixed to the lower banner bracket of the structural pole for supporting the elongate housing upon the structural pole.

26. The speaker assembly of claim 25 wherein the housing further comprises a height oriented in an axial direction of the structural pole, a width oriented in a direction that the banner brackets extend from the structural pole, and a depth oriented generally perpendicular to the height and the width, wherein the depth is less than or equal to a diameter of a region of the structural pole oriented between the banner brackets.

* * * * *

UNITED STATES PATENT AND TRADEMARK OFFICE

CERTIFICATE OF CORRECTION

PATENT NO. : 7,607,512 B2
APPLICATION NO. : 11/209794
DATED : October 27, 2009
INVENTOR(S) : Ronald Paul Harwood It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 522 days.

Signed and Sealed this

Twelfth Day of October, 2010

David J. Kappos

David J. Kappos
*Director of the United States Patent and Trademark Office*